US011466968B1

(12) United States Patent
Garstka

(10) Patent No.: US 11,466,968 B1
(45) Date of Patent: Oct. 11, 2022

(54) RESETTING TARGET SYSTEM

(71) Applicant: Robert Douglas Garstka, East Haddam, CT (US)

(72) Inventor: Robert Douglas Garstka, East Haddam, CT (US)

( * ) Notice: Subject to any disclaimer, the term of this patent is extended or adjusted under 35 U.S.C. 154(b) by 123 days.

(21) Appl. No.: 17/158,084

(22) Filed: Jan. 26, 2021

(51) Int. Cl.
*F41J 7/04* (2006.01)

(52) U.S. Cl.
CPC ..... *F41J 7/04* (2013.01)

(58) Field of Classification Search
CPC ..... F41J 7/04
See application file for complete search history.

(56) References Cited

U.S. PATENT DOCUMENTS 5,324,043 A 6/1994 Estrella
6,896,267 B1 5/2005 Anna
7,731,197 B2 6/2010 Stutz
9,574,855 B2 2/2017 Davis
10,088,279 B2 * 10/2018 Hoy, Jr. ..... F41J 1/10
10,139,203 B1 * 11/2018 Teal ..... F41J 1/10
2004/0195775 A1 * 10/2004 Goldsmith, Jr. ..... F41J 7/04 273/392
2011/0233868 A1 9/2011 Massier
2016/0327369 A1 11/2016 Gratrix
2019/0219370 A1 * 7/2019 Anderson ..... F41J 1/10

* cited by examiner

*Primary Examiner* — Laura Davison
(74) *Attorney, Agent, or Firm* — Kintner IP, LLC; Mary Frances Ludwig

(57) ABSTRACT

A resetting target system includes a reset subassembly and a target subassembly which are separately positionable along a support rail. An arm of a reset plate is removably coupled to a reset bar. The reset bar is inserted through the target subassembly. When the reset bar is actuated by striking the reset plate, the reset bar pivots a latch of the target subassembly and frees a target from a latched position. One reset bar may engage with one or more target subassemblies, and multiple reset bars may be interconnected and coupled to a single reset plate. The target system is modular, adjustable, and easy to assemble.

15 Claims, 7 Drawing Sheets

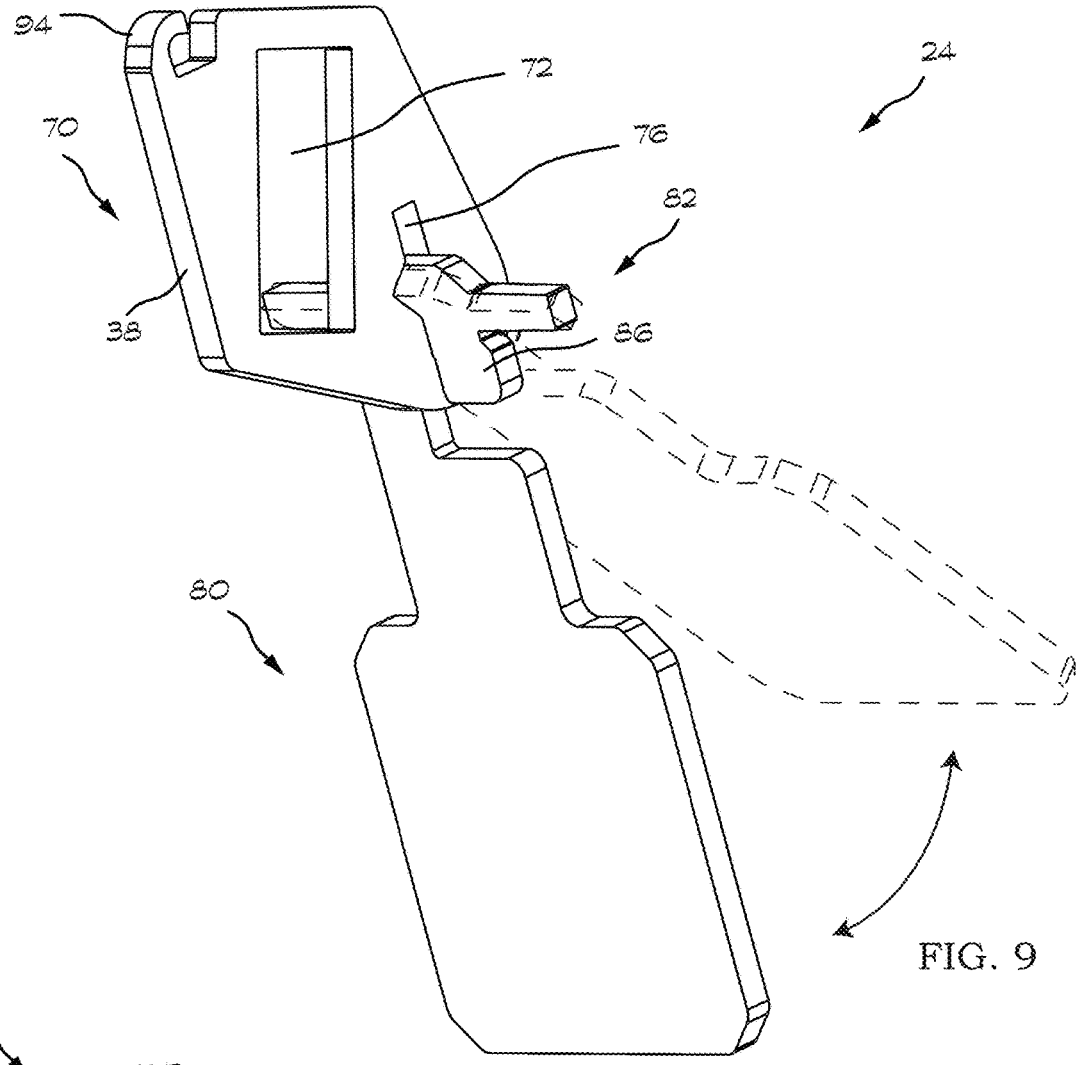
FIG. 9
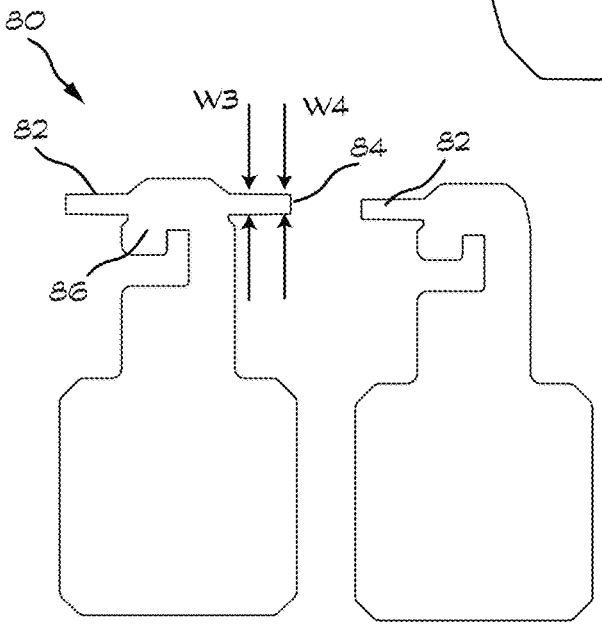
FIG. 10A
FIG. 10B
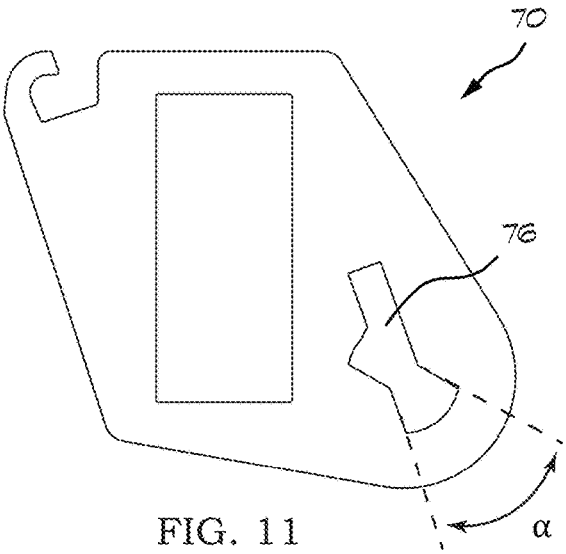
FIG. 11

RESETTING TARGET SYSTEM

TECHNICAL FIELD

The present invention pertains generally to shooting targets, and more particularly to a resetting target system.

BACKGROUND OF THE INVENTION

Shooting targets are popular training tools for marksmen and hunters, and are also used recreationally. A resetting target is generally displaced when struck by a projectile, and cooperates with a mechanism which returns the target to its original position.

Resetting target systems may be made of durable materials, such as steel, to withstand repeated impacts from bullets. Such systems are often difficult to transport due to their weight. These systems may have limited or no ability to adjust target positions. Furthermore, the cost of such systems may be prohibitive.

BRIEF SUMMARY OF THE EMBODIMENTS

Embodiments disclosed herein are directed to a resetting target system which is modular, adjustable, and easy to assemble. A reset subassembly provides the resetting mechanism for one or more targets. The reset subassembly and each target subassembly are individually positionable along a support rail. The support rail may be an inexpensive and lightweight material, such as a piece of lumber, which may be replaced by the user to achieve different configurations or when damaged. Targets may be removed from the target subassemblies for replacement, reconfiguration, or transport. The modular nature of the system allows a user to set up a variable number of targets, assemble the system with different support rail configurations, or expand the system over time.

According to one or more embodiments, a resetting target system cooperates with a support rail. The system includes a reset plate support and one or more target supports, each of which has an aperture shaped and dimensioned to receive the support rail. A target is coupled to the target support and a reset plate is coupled to the reset plate support. The reset plate has an arm which is removably coupled to a reset bar by a sleeve. The reset bar is inserted through the a reset bar hole in the target support, and the target support is slidably positionable along the reset bar to a desired location.

A latch is secured to the target support and has a notch configured to retain the target in a latched position. The latch is pivotal about the reset bar hole. When the reset plate is struck, it rotates within the reset plate support and also rotates the reset bar coupled thereto. The reset bar is shaped to contact the latch when rotated, thereby causing the latch to pivot and freeing the target from the latched position. One reset bar may engage with one or more target subassemblies, and multiple reset bars may be interconnected and coupled to a single reset plate. This mechanism allows multiple targets to be reset by striking a single reset plate.

According to one or more embodiments, the reset plate may have two opposing arms, and each arm may be configured to removably couple to the sleeve.

According to one or more embodiments, the target may be removably coupled to the target support.

According to one or more embodiments, the target may have a hook configured to pass through a slot in the target support and couple the target to the target support.

According to one or more embodiments, the reset bar may have a substantially rectangular cross-section orthogonal to a longitudinal axis of the reset bar.

According to one or more embodiments, the latch may have an internal face configured for engagement with the reset bar when the reset bar is rotated, whereby the latch may be pivoted from an engageable position to a withdrawn position. A spring may be connected between the latch and the target support and configured to pivot the latch from the withdrawn position to the engageable position.

According to one or more embodiments, the latch may be retainable against the target support in the withdrawn position.

According to one or more embodiments, the arm of the reset plate may have an arm cross-section tapering toward an outside face.

According to one or more embodiments, the end of the reset bar may taper outwardly.

According to one or more embodiments, the system includes a guard plate configured for removable attachment to the target support. The guard plate is angled downwardly when attached to the target support, and sized to shield the target support from a frontal impact. In some embodiments, the guard plate is angled downwardly by at least 20 degrees when attached to the target support.

According to one or more embodiments, the target support may have a forward surface which is angled downwardly by at least 20 degrees.

According to one or more embodiments, the reset plate may be pivotal within the reset plate support over an arc subtending about a 45 degree angle.

These and other aspects of the embodiments will be better appreciated and understood when considered in conjunction with the following description and the accompanying drawings. The following description, while indicating various embodiments and details thereof, is given by way of illustration and not of limitation. Many substitutions, modifications, additions, or rearrangements may be made within the scope of the embodiments, and the embodiments may include all such substitutions, modifications, additions, or rearrangements.

BRIEF DESCRIPTION OF THE DRAWINGS

Non-limiting and non-exhaustive embodiments of the resetting target system are described with reference to the following figures, wherein like reference numerals refer to like parts throughout the various views unless otherwise specified.

FIG. 9 is an enlarged front perspective view of a reset subassembly.

FIGS. 10A-10B are front elevation views of embodiments of a reset plate.

FIG. 11 is a side elevation view of an embodiment of a reset plate support.

Figure 1:
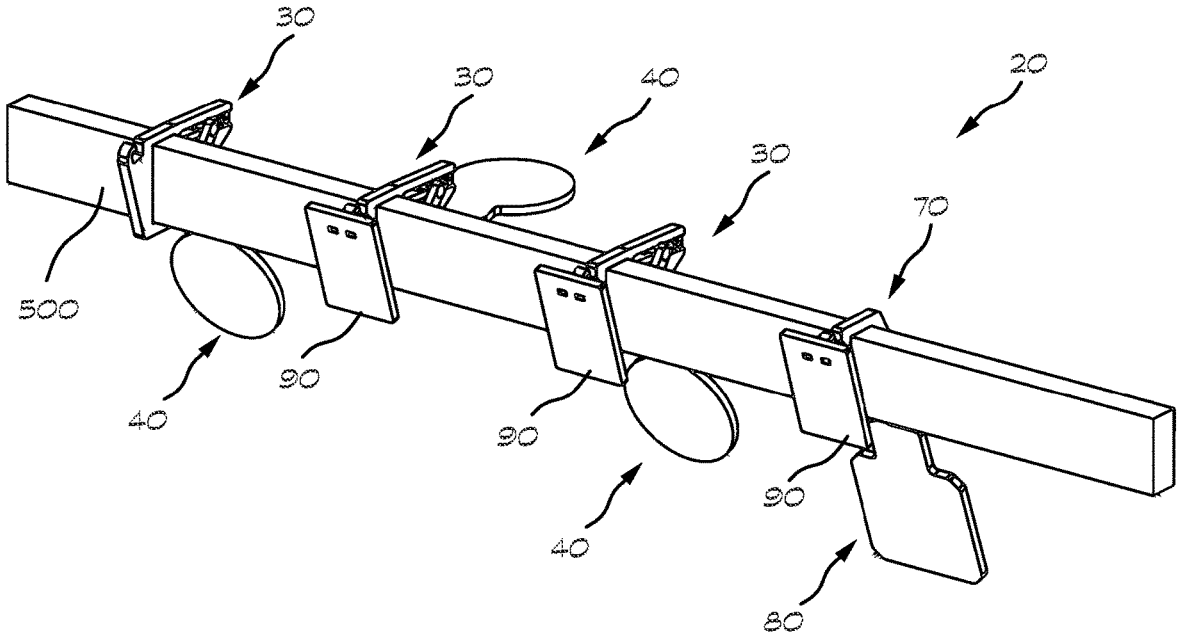
FIG. 1 is a front perspective view of a resetting target system.
Figure 2:
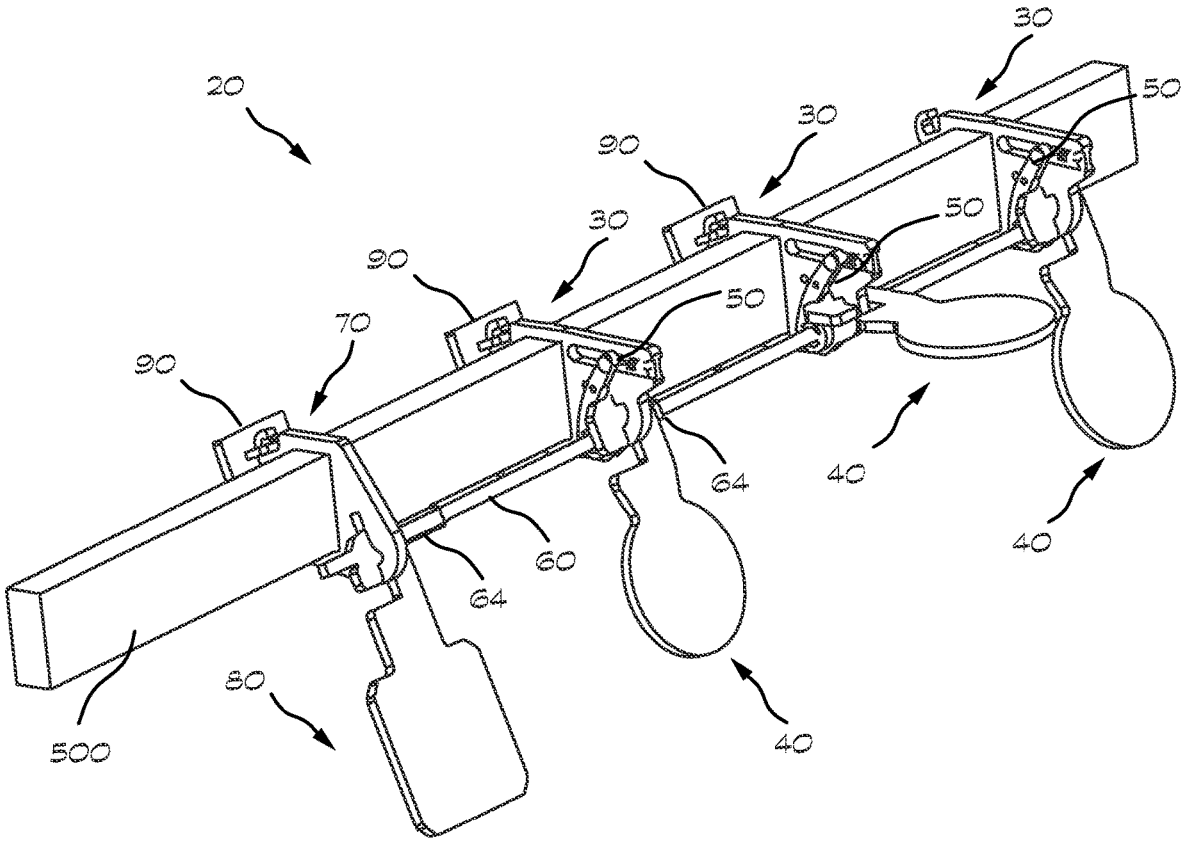
FIG. 2 is a rear perspective view of the resetting target system.

Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments. Also, common but well-understood elements that are useful or necessary in a commercially feasible embodiment are often not depicted in order to facilitate a less obstructed view of these various embodiments.

LIST OF DRAWING REFERENCE NUMERALS

20 system
- 22 target subassembly
- 24 reset subassembly target support
- 32 aperture
- 33 spring hole
- 34 reset bar hole
- 35 axle
- 36 slot
- 37 retainer
- 38 forward surface
- 39 channel

40 target
- 42 hook

=latch
- 51 upper end
- 52 notch
- 53 axle hole
- 54 internal face
- 55 pin
- 56 spring
- 57 nut

60 reset bar
- 62 longitudinal axis
- 64 sleeve
- 66 end

70 reset plate support
- 72 reset plate aperture
- 76 reset plate slot

80 reset plate
- 82 arm
- 84 outside face
- 86 reset plate hook

90 guard plate
- 92 loop
- 94 guard hook

500 support rail

DETAILED DESCRIPTION OF THE INVENTION

FIGS. 1-4 illustrate front and rear perspective, front elevation, and enlarged side elevation views, respectively, of an embodiment of a resetting target system generally designated as 20. The shown embodiment includes three target supports 30, each having a target 40 coupled thereto. A reset plate support 70 has a reset plate 80 coupled thereto. Target supports 30 and reset plate support 70 are positioned along a cooperating support rail 500. A reset bar 60 couples reset plate 80 to a latch 50. One latch 50 is secured to each target support 30.

Figure 5:
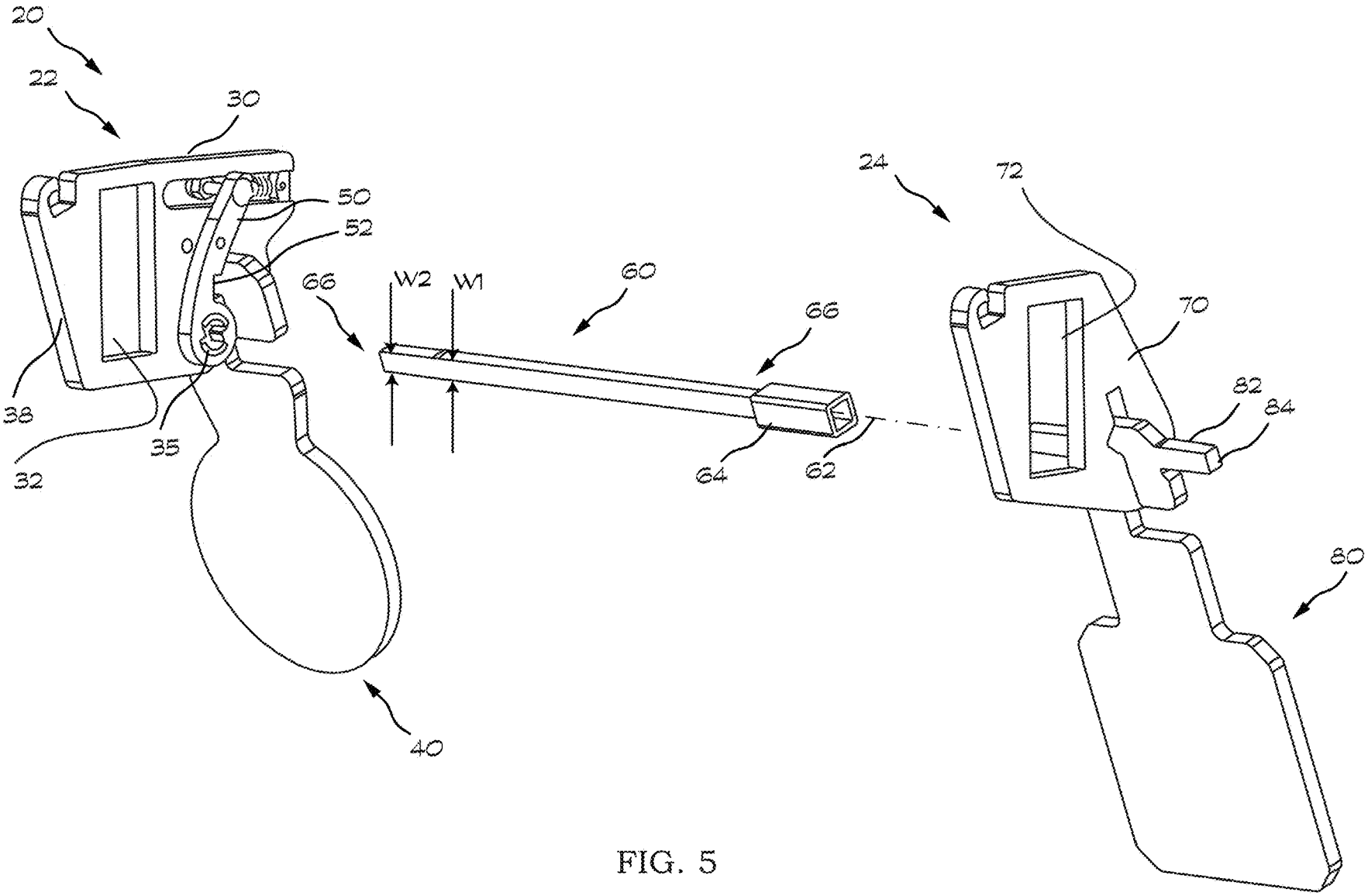
FIG. 5 is an enlarged, exploded, front perspective view of the resetting target system.

FIG. 5 is an enlarged, exploded, front perspective view of another embodiment of resetting target system 20. The combination of target support 30, target 40, latch 50, and cooperating hardware is referred to herein as target subassembly 22. The combination of reset plate support 70 and reset plate 80 is referred to herein as reset subassembly 24. The shown embodiment includes one target subassembly 22 and one reset subassembly 24.

Target support 30 has an aperture 32 shaped and dimensioned to receive support rail 500 (shown in FIGS. 1-4). Support rail 500 may be a length of dimensional lumber, such as a 2×4 or 2×6. Aperture 32 may be dimensioned slightly larger than support rail 500 so that target support 30 may easily slide on to support rail 500. Aperture 32 may be configured to partially surround support rail 500, for example aperture 32 may have an inverted U shape. Similarly, reset plate support 70 has a reset plate aperture 72 shaped and dimensioned to receive the support rail 500.

Reset plate 80 has at least one arm 82 (two arms 82 are present in the shown embodiment). A sleeve 64 is configured to removably couple an end 66 of reset bar 60 to arm 82. For example, one side of sleeve 64 may slide over an end 66 of reset bar 60 and an opposite side of sleeve 64 may slide over arm 82. Sleeve 64 is non-destructively removable from either one or both of end 66 and arm 82. In this manner reset bar 60 and reset plate 80 may be readily disassembled as desired for transport, storage, or reconfiguration of the system.

Figure 6:
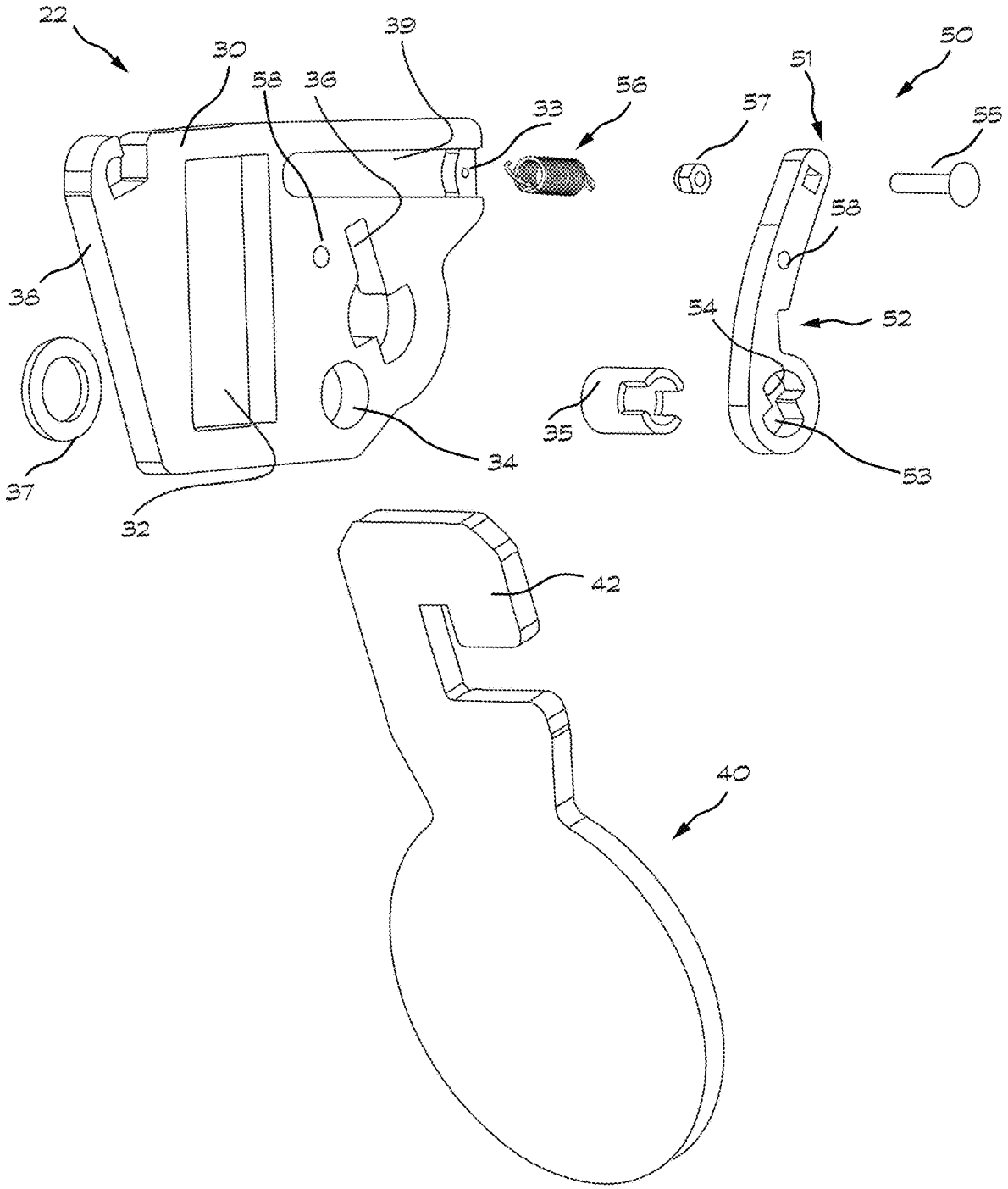
FIG. 6 is an enlarged, exploded, front perspective view of a target subassembly.

FIG. 6 is an enlarged, exploded, front perspective view of target subassembly 22. A reset bar hole 34 projects through target support 30. Latch 50 is secured to target support 30 in a manner which allows latch 50 to pivot about reset bar hole 34. In the shown embodiment, an axle 35 is located within reset bar hole 34 and has ends which protrude through reset bar hole 34 on either side of target support 30. Latch 50 has an axle hole 53 which receives one end of axle 35. Latch 50 is fixed to axle 35, such as by welding or brazing. A retainer 37 is fixed to the opposite end of axle 35, such as by welding, brazing, or threaded mating.

A pin 55 is affixed to an upper end 51 of latch 50 and protrudes through a channel 39 of target support 30. In an embodiment, pin 55 is a carriage bolt with a threaded end extending beyond channel 39 opposite latch 50. A nut 57 may be coupled to pin 55. Pin 55 may have a head which may be immovably affixed to latch 50, such as by welding.

A spring 56 is housed within channel 39 and connects pin 55 to target support 30. As latch 50 pivots about reset bar hole 34, pin 55 travels forward and backward within channel 39 resulting in extension or compression of spring 56. In the shown embodiment spring 56 is connected to target support 30 by hooking on to a spring hole 33 located rearward of channel 39. In embodiments, target support 30 and channel 39 are sized such that spring 56 does not extend beyond the sides of target support 30 (i.e., spring 56 is fully housed within channel 39). This arrangement helps to shield the spring from spall. In an embodiment spring 56 is about 2.2 inches long, about 0.375 inches in diameter, and has a spring tension of about 1.5 lbs.

As used in this application, the term "about" refers to a range of values within plus or minus 10% of the specified number.

Referring again to FIG. 5, reset bar 60 may be inserted through the reset bar hole of target subassembly 22. In embodiments where axle 35 is located in reset bar hole 34 (see FIG. 6), reset bar 60 may be passed through axle 35. Target support 30 is slidably positionable along a longitudinal axis 62 of reset bar 60. In this way target support 30 may be positioned at a variable distance from reset plate support 70, as desired by the user. For example, each target support 30 may be slidably positioned along longitudinal axis 62 as indicated by the directional arrows shown in FIG. 3.

Figure 8A:
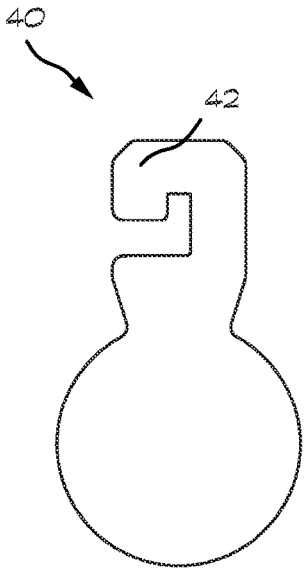
FIGS. 8A-8C are front elevation views of embodiments of a target.
Figure 8B:
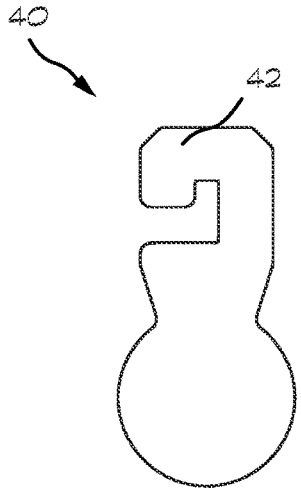
Figure 8C:
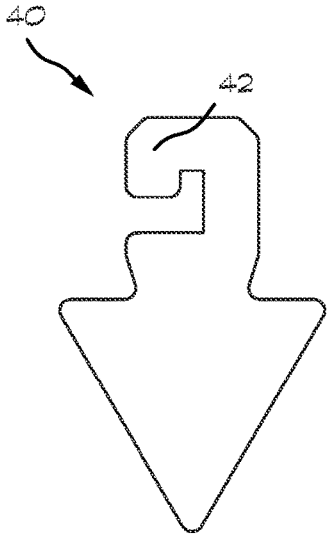

In embodiments, target 40 may be removably coupled to target support 30. As shown in FIG. 6, target support 30 may have a slot 36 shaped to receive a hook 42 of target 40. This feature allows the forward-facing side of target 40 to be reversed, which may extend the life of the target. This feature also allows target 40 to be easily replaced with a new target or with a target of a different size or shape. FIGS. 8A-8C are front elevation views of exemplary embodiments of target 40, each having a hook 42 for removable coupling to the target support. Targets 40 may have various shapes and sizes. For example, target 40 of FIG. 8A is generally circular. Target 40 of FIG. 8B is generally circular and smaller than the target of FIG. 8A. Target 40 of FIG. 8C is generally triangular. In one embodiment, the shape of reset plate 80 is different from the shape of targets 40 to allow a user to visually differentiate the reset plate (see, e.g., FIG. 3).

Figure 7:
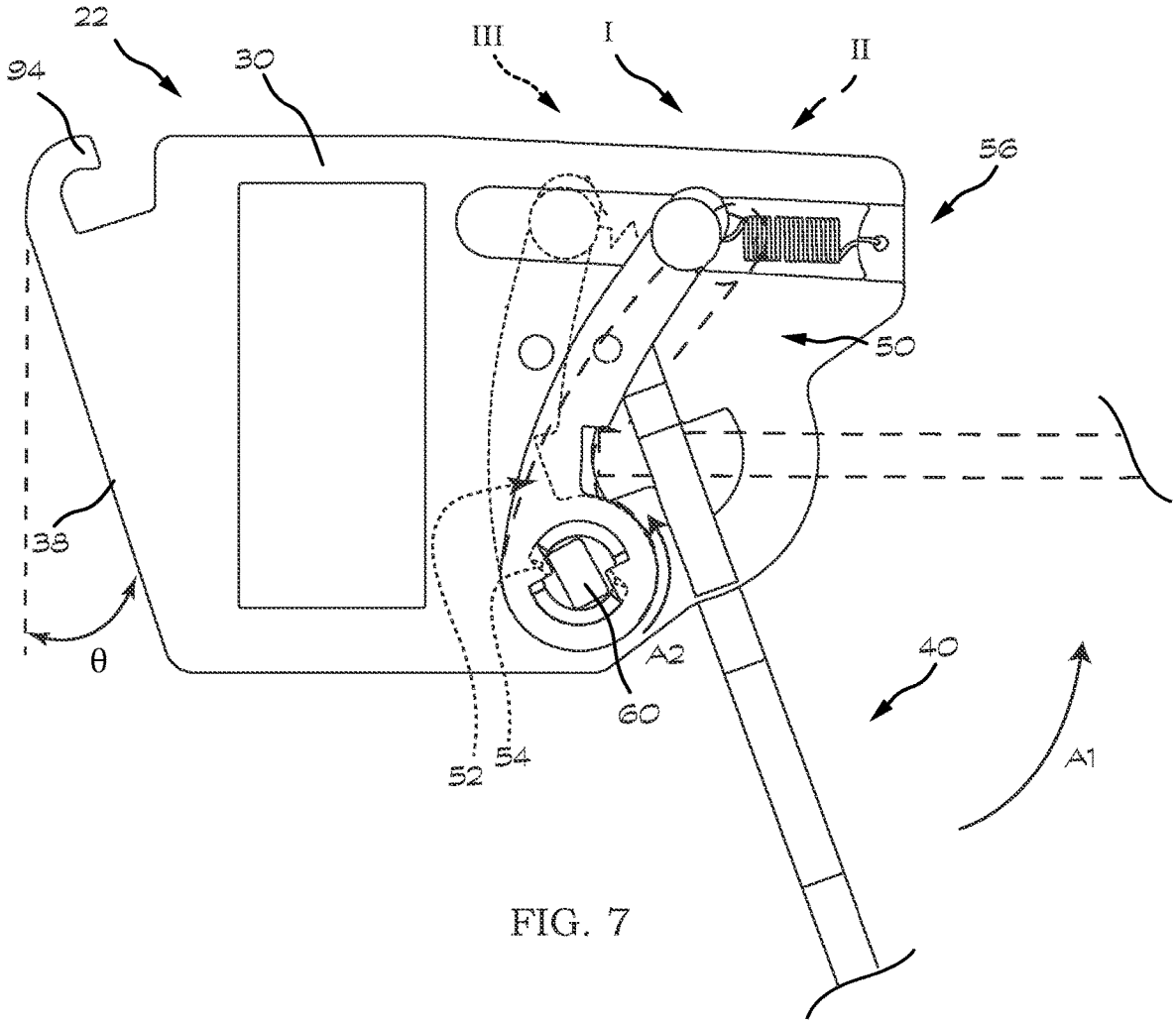
FIG. 7 is an enlarged side elevation view of the target subassembly.

FIG. 7 is an enlarged side elevation view of target subassembly 22 coupled to a reset bar 60. Position I, shown in solid lines, illustrates target 40 in an unlatched position and latch 50 in an engageable position. In position I, target 40 is free-hanging and substantially forward-facing for targeting. The upper end of target 40 may contact latch 50, which may cause spring 56 to be slightly extended in position I.

Latch 50 has a notch 52 (see also FIG. 6) which is configured to retain target 40 in a latched position. When struck, target 40 moves from position Ito position II (shown in dashed lines) along directional arrow A1. In position II, target 40 is engaged with notch 52 of latch 50. With target 40 thus engaged, spring 56 may draw latch 50 rearwardly as shown. Target 40 will remain engaged in the latched position until latch 50 is withdrawn, either by action of the reset bar 60 or manually.

FIG. 9 is an enlarged front perspective view of reset subassembly 24. As also shown in FIGS. 10 & 11, reset plate support 70 may have a reset plate slot 76 shaped to receive a reset plate hook 86 of reset plate 80. This feature allows the reset plate to be readily removed from the reset plate support, such as for disassembly or replacement. When struck, reset plate 80 pivots about longitudinal axis 62 (see FIG. 5) to the position shown in dashed lines in FIG. 9. Reset plate 80 returns to the original position (shown in solid lines) due to gravity.

The rotation of reset plate 80 when struck rotates reset bar 60 which is coupled to reset plate 80 (see FIGS. 1-5). When rotated reset bar 60 contacts an internal face 54 of latch 50 and pivots latch 50 in the direction of arrow A2 to position III of FIG. 7 (shown in dotted lines). Pivoting the latch forward disengages target 40 from notch 52, freeing target 40 which returns to the unlatched position. Spring 56 draws latch 50 rearwardly from the withdrawn position (III) to the engageable position (I).

In some embodiments, latch 50 may be retained in the withdrawn position, for example by inserting a pin or the like in a through hole 58 (see FIG. 6, 7). In this configuration the target will not engage the latch, allowing repeated shooting of the target without the need to reset.

In embodiments, reset bar 60 has a substantially rectangular cross-section as viewed orthogonal to longitudinal axis 62. In some embodiments, reset bar 60 may have a substantially square cross-section. End 66 of the reset bar may taper outwardly for ease of fitting with sleeve 64. For example, as shown in FIG. 5, reset bar 60 may have a width W1 which tapers outwardly to a decreased width W2 near end 66. W2 may be slightly smaller than the inner dimension of sleeve 64. W1 may be slightly larger than the inner dimension of sleeve 64. This taper allows end 66 to slide into sleeve 64 to the point of a slight press fit, while being readily separated by the user.

In an embodiment, both ends 66 of the reset bar taper outwardly. In another embodiment, one end 66 tapers outwardly and the other end 66 has a constant width sized to be closely received within sleeve 64. In some embodiments, sleeve 64 is welded or otherwise immovably connected to one end of the reset bar.

FIGS. 10A & 10B are front elevation views of embodiments of reset plate 80 having two or one of arm 82, respectively. Each arm 82 is configured to removably couple to sleeve 64. Each arm 82 may have an arm cross-section tapering toward an outside face 84. For example, as shown in FIG. 10A, arm 82 may have a width W3 which tapers outwardly to a decreased width W4 near outside face 84. W4 may be slightly smaller than the inner dimension of sleeve 64. W3 may be slightly larger than the inner dimension of sleeve 64. This taper allows arm 82 to slide into sleeve 64 to the point of a slight press fit, while being readily separated by the user. A sleeve and reset bar may be coupled to either one or both of arm 82, depending on the target arrangement desired by the user.

A plurality of target subassemblies may be connected to and reset by a single reset subassembly. In some embodiments of system 20 a plurality of reset bars are coupled to one another with sleeves 64. One or more target subassemblies may be directly coupled to each of the plurality of reset bars (i.e., each reset bar may pass through the axle hole of one or more target subassemblies). In the embodiment of FIGS. 1-4, two reset bars 60 of different lengths are connected to one reset subassembly, which is located on an end of the system. One target subassembly is directly coupled to one of the reset bars, while two target subassemblies are directly coupled to the other reset bar. In other embodiments, a single reset bar may be directly coupled to a plurality of target subassemblies.

Figure 12:
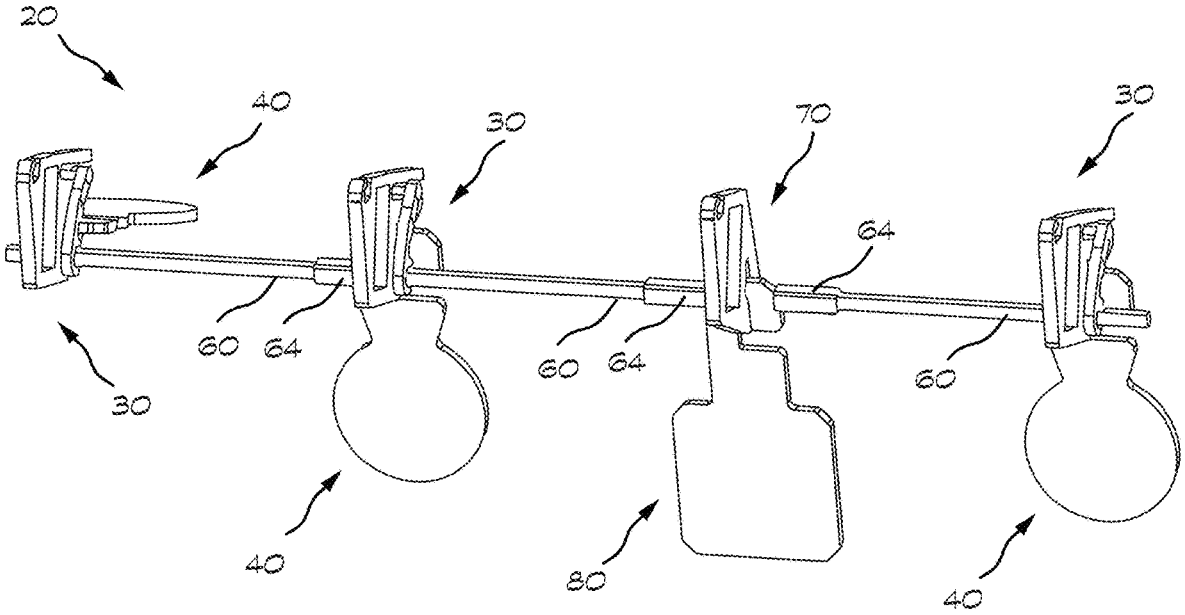
FIG. 12 is a front perspective view of another embodiment of the resetting target system.

FIG. 12 is a front perspective view of another embodiment of resetting target system 20, where reset plate 80 has two arms and a sleeve 64 is coupled to each arm. In this embodiment, reset plate 80 is located between two targets 40. Three reset bars 60 are present; on one side of the reset plate two reset bars are coupled together by a sleeve 64 and connected to an arm of the reset plate with another sleeve 64 and on the other side of the reset plate one reset bar is connected to the other arm. When reset plate 80 is struck all three of the connected reset bars 60 rotate, causing the three targets 40 to be reset to their unlatched positions.

Figure 13:
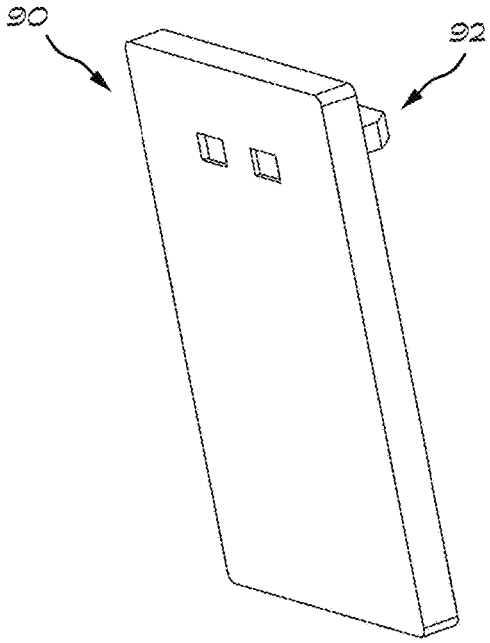
FIG. 13 is a front perspective view of an embodiment of a guard plate.
Figure 14:
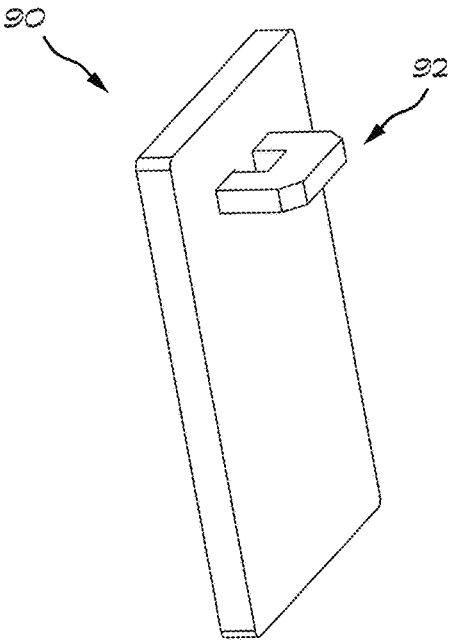
FIG. 14 is a rear perspective view of the guard plate.

FIGS. 13 & 14 are front and rear perspective views, respectively, of an embodiment of a guard plate 90 for use with target support 30 or reset plate support 70. Guard plate 90 is configured for removable attachment to target support 30, such as by coupling a loop 92 to a guard hook 94 (see FIGS. 4, 7). Guard plate 90 may be attached to guard hook 94 of reset plate support 70 in a similar manner (see FIG. 9).

Figure 3:
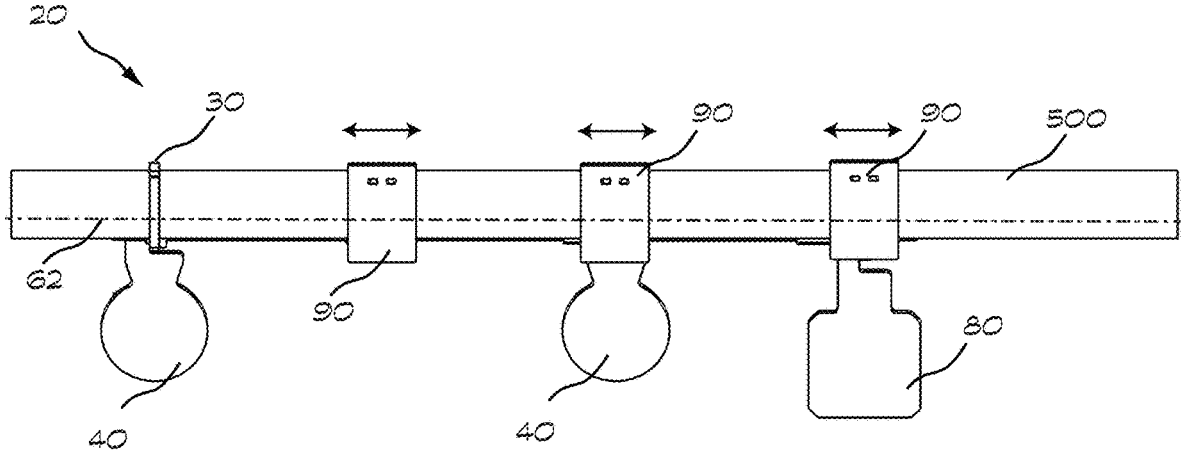
FIG. 3 is front elevation view of the resetting target system.
Figure 4:
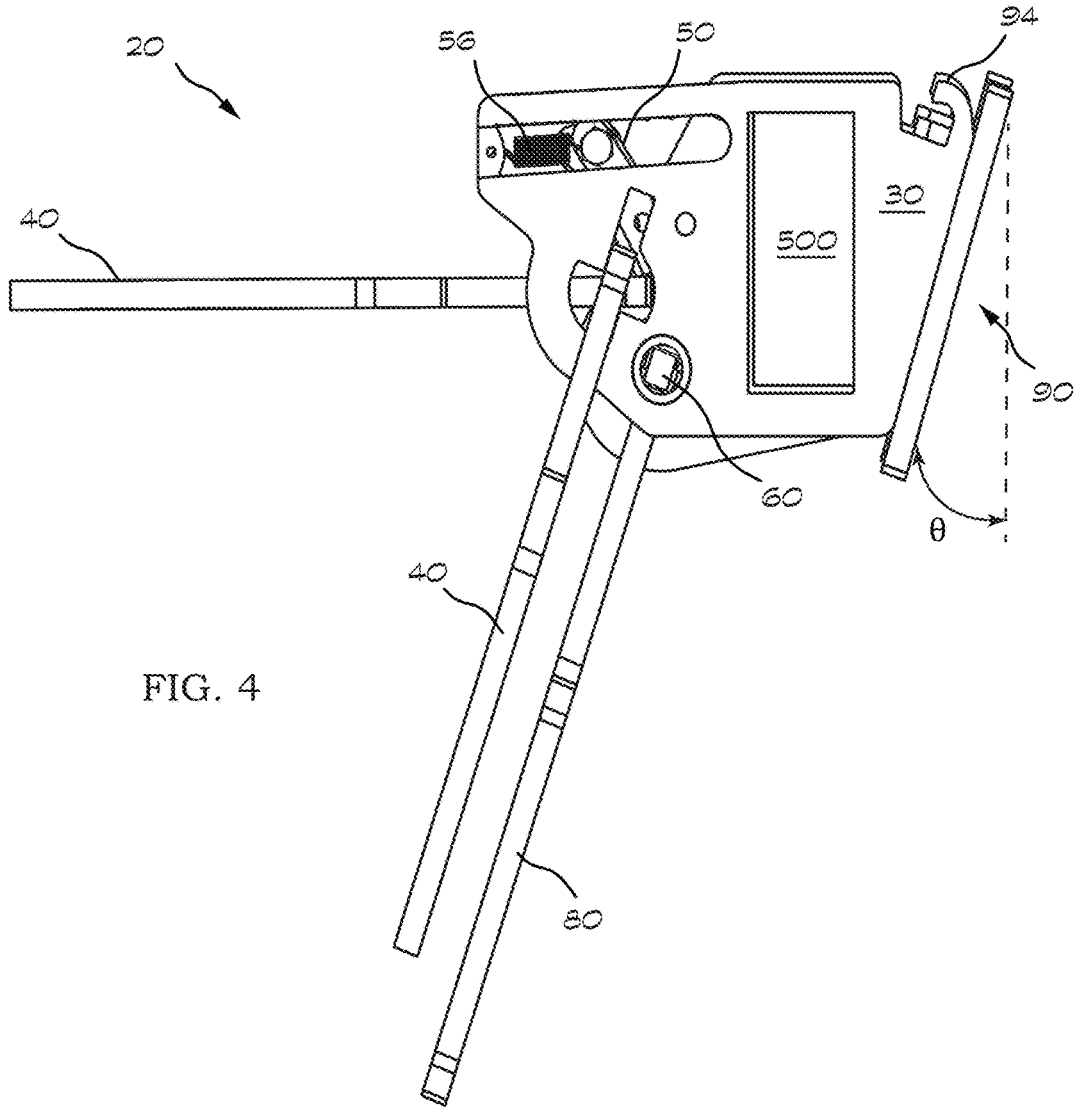
FIG. 4 is an enlarged side elevation view of the resetting target system.

The guard plate is sized to shield the target support or reset plate support from a frontal impact, as seen in FIGS. 3-4. As shown in FIG. 4, guard plate 90 is angled downwardly by an angle ⊖, to deflect bullets toward the ground. In embodiments, ⊖ is at least 20 degrees. When connected to guard hook 94 of target support 30, guard plate 90 rests against forward surface 38 which is also angled downwardly by an angle ⊖. Should the user choose not to use a guard plate, the downward angle of forward surface 38 will serve to deflect impacting bullets toward the ground. Reset plate 70 may have a forward surface 38 which is angled downwardly in a similar manner.

In embodiments, guard hook 94 is shaped to prevent guard plate 90 from becoming accidentally dislodged when impacted. Guard hook 94 may curve or extend rearwardly over loop 92 to prevent upward movement of guard plate 90.

In embodiments, slot 36 and reset plate slot 76 may be configured so that a target or reset plate coupled thereto are positioned with a downward angle. Slot 36 may support target 40 at a downward angle of at least 20 degrees (FIG. 6). Reset plate slot 76 may support reset plate 80 at a downward angle of at least 20 degrees (FIG. 11).

Slot 76 may be shaped to allow the reset plate to pivot over a limited angular range, α. The range of motion may be selected to prevent over-rotation of a connected latch, which could cause a latch to impact the support rail; over-extension of the spring; or other undesirable mechanical interference. The selected range of motion will therefore depend upon dimensions of a specific system. In one embodiment the reset plate may pivot over an angular range of about 45 degrees.

Parts of the system may be made of hardened steel, such as AR500, to minimize damage from spall. In an exemplary embodiment, the target support and reset support are made of AR500 in about 0.5 inch thickness and the target is made of AR500 in about 0.375 inch thickness.

In embodiments, the reset bar may be a steel rectangular tube. The reset bar may have a length of about 12, 18, 24, 30, or 36 inches.

The cooperating support rail 500 may be wood or other material in any length desired by the user. The user may provide a mounting mechanism for support rail 500, such as a frame, bracket, or clamp, to position the support rail at a desired height and restrict rotation of the rail.

Further provided is a target subassembly 22, for cooperation with a support rail 500, a reset bar 60, and a reset subassembly 24.

In terms of use, a method of configuring a resetting target system 20 includes: (refer to FIGS. 1-14)

(a) providing a support rail 500;

(b) passing the support rail through a reset plate aperture 72 of a reset plate support 70;

(c) passing the support rail through an aperture 32 of a target support 30;

(d) using a sleeve 64 to removably couple an end 66 of a reset bar 60 to an arm 82 of a reset plate 80;

(e) inserting the reset bar through a reset bar hole 34 of the target support;

(f) positioning the target support by sliding along the support rail and the reset bar to a desired location;

(g) coupling the reset plate to the reset plate support; and, (h) coupling a target 40 to the target support.

The method may further include using a sleeve to removably couple an end of a first reset bar to an end of a second reset bar.

The method may further include removably attaching a guard plate 90 to the target support.

The method may further include passing the support rail through aperture 32 of each of a plurality of target supports 30 and positioning the plurality of target supports by sliding along the support rail and the reset bar to desired locations.

The method may further include retaining a latch 50 against the target support in a withdrawn position.

The embodiments of the resetting target system and methods of use described herein are exemplary and numerous modifications, combinations, variations, and rearrangements can be readily envisioned to achieve an equivalent result, all of which are intended to be embraced within the scope of the appended claims. Further, nothing in the above-provided discussions of the system and method should be construed as limiting the invention to a particular embodiment or combination of embodiments. The scope of the invention is defined by the appended claims.

I claim:

1. A resetting target system configured for cooperation with a support rail, the system comprising:

a target support having an aperture shaped and dimensioned to receive the support rail;

a target coupled to the target support;

a latch secured to the target support and having a notch configured to retain the target in a latched position, the latch pivotal about a reset bar hole projecting through the target support;

a reset bar dimensioned for insertion through the reset bar hole such that the target support is slidably positionable along a longitudinal axis of the reset bar, the reset bar shaped to contact the latch when rotated thereby causing the latch to pivot;

a reset plate support having a reset plate aperture shaped and dimensioned to receive the support rail;

a reset plate coupled to the reset plate support, the reset plate having an arm; and, a sleeve configured to removably couple an end of the reset bar to the arm of the reset plate, so that rotation of the reset plate rotates the reset bar coupled thereto, pivoting the latch and freeing the target from the latched position.

2. The system according to claim 1, further including:

the reset plate having two opposing arms, each arm configured to removably couple to the sleeve.

3. The system according to claim 1, wherein:

the target is removably coupled to the target support.

4. The system according to claim 3, further including:

the target having a hook configured to pass through a slot in the target support and couple the target to the target support.

5. The system according to claim 1, further including:

the reset bar having a substantially rectangular cross-section orthogonal to the longitudinal axis.

6. The system according to claim 1, further including:

the latch having an internal face configured for engagement with the reset bar when the reset bar is rotated, whereby the latch is pivoted from an engageable position to a withdrawn position; and a spring connected between the latch and the target support and configured to pivot the latch from the withdrawn position to the engageable position.

7. The system according to claim 6, wherein:

the latch is retainable against the target support in the withdrawn position.

8. The system according to claim 1, further including:

the arm of the reset plate having an arm cross-section tapering toward an outside face.

9. The system according to claim 1, further including:
the end of the reset bar tapering outwardly.

10. The system according to claim 1, further including:
a guard plate configured for removable attachment to the target support, being angled downwardly when attached, and sized to shield the target support from a frontal impact.

11. The system according to claim 10, further including:
the guard plate being angled downwardly by at least 20 degrees when attached to the target support.

12. The system according to claim 1, further including:
the target support having a forward surface angled downwardly by at least 20 degrees.

13. The system according to claim 1, wherein:
the reset plate is pivotal within the reset plate support over an arc subtending about a 45 degree angle.

14. The system according to claim 1, further including:
a plurality of target supports each having an aperture shaped and dimensioned to receive the support rail; and
a plurality of targets each coupled to one of the plurality of target supports.

15. A resetting target system configured for cooperation with a support rail, the system comprising:
a plurality of target supports each having a reset bar hole projecting therethrough and an aperture shaped and dimensioned to receive the support rail;
a plurality of targets each removably coupled to one of the plurality of target supports;
a plurality of latches each secured to one of the plurality of target supports and each having a notch configured to retain one of the plurality of targets in a latched position, each of the plurality of latches pivotal about the reset bar hole of the one of the plurality of target supports secured thereto;
a reset bar dimensioned for insertion through the reset bar holes such that each of the plurality of target supports is slidably positionable along a longitudinal axis of the reset bar, the reset bar shaped to contact the plurality of latches when rotated thereby causing the plurality of latches to pivot;
a reset plate support having a reset plate aperture shaped and dimensioned to receive the support rail;
a reset plate coupled to the reset plate support, the reset plate having two opposing arms; and,
a sleeve configured to removably couple an end of the reset bar to one of the arms of the reset plate, so that rotation of the reset plate rotates the reset bar coupled thereto, pivoting the latches and freeing the targets from the latched position.

* * * * *